US005487650A

United States Patent [19]

Gaston et al.

[11] Patent Number: 5,487,650

[45] Date of Patent: Jan. 30, 1996

[54] AUTOMOTIVE FUEL PUMP WITH HELICAL IMPELLER

[75] Inventors: Robert D. Gaston, Dearborn Heights; Dequan Yu, Ann Arbor, both of Mich.

[73] Assignee: Ford Motor Company, Dearborn, Mich.

[21] Appl. No.: 162,566

[22] Filed: Dec. 7, 1993

[51] Int. Cl.[6] ..... F03B 3/12

[52] U.S. Cl. ..... 417/423.3; 415/72

[58] Field of Search ..... 417/423.3, 423.8; 415/72, 73

[56] References Cited

U.S. PATENT DOCUMENTS

| | | | |
|---|---|---|---|
| 2,760,437 | 8/1956 | Stefano | 415/72 |
| 2,845,871 | 8/1958 | Compton | 417/366 |
| 2,846,952 | 12/1958 | Ridland | 415/72 |
| 2,887,959 | 2/1959 | DiStefano | 96/214 |
| 2,925,043 | 2/1960 | Howe | 417/366 |
| 3,107,626 | 10/1963 | Thoren et al. | 417/423.1 |
| 3,431,855 | 3/1969 | Kazantsev et al. | 415/73 |
| 3,522,997 | 8/1970 | Rylewski | 415/72 |
| 3,602,604 | 8/1971 | Ronellenfitch | 415/72 |
| 4,481,020 | 11/1984 | Lee et al. | 415/73 |
| 4,545,742 | 10/1985 | Schaefer | 417/366 |
| 5,073,082 | 12/1991 | Radlik | 415/72 |
| 5,324,177 | 6/1994 | Golding et al. | 417/423.1 |

FOREIGN PATENT DOCUMENTS

| | | | |
|---|---|---|---|
| 4123384 | 1/1993 | Germany . | |
| 354551 | 8/1931 | United Kingdom | 417/366 |

*Primary Examiner*—Richard A. Bertsch
*Assistant Examiner*—Peter G. Kurytnyk
*Attorney, Agent, or Firm*—David B. Kelley; Roger L. May

[57] ABSTRACT

A fuel pump has a motor mounted within a housing with a shaft extending therefrom to which a helically shaped impeller is fitted having at least two turns for pumping fuel from a fuel tank to an automotive engine. The impeller has an involute shaped leading edge designed to efficiently scoop fuel from an inlet into a pumping chamber formed between the helically shaped blade turns comprising the impeller. A trailing edge on the impeller has a narrowed width which increases the effective flow cross-sectional area, thus increasing the fuel pressure. The helically shaped impeller needs no separate casing, as is typically required for conventional fuel pumps employing regenerative turbines, gerotors, roller vanes, or the like, and increases fuel pressure over a longer circumferential distance thus decreasing cavitation.

17 Claims, 3 Drawing Sheets

AUTOMOTIVE FUEL PUMP WITH HELICAL IMPELLER

FIELD OF THE INVENTION

This invention relates to automotive fuel pumps, and, more particularly, to an automotive fuel pump with an axial flow helically shaped impeller.

BACKGROUND OF THE INVENTION

Various types of in-tank or in-line fuel pumps are used for pumping fuel from the fuel tank to the engine of an automobile. One distinguishing feature among fuel pumps is the type of pumping mechanism employed. For example, gerotors, roller vanes, and regenerative turbines are common due to their compactness and ability to generate relatively high pressures, in the range of 3.5 psi to 150 psi (20 kpa to 1035 kpa). Since these pumps must rotate at high speeds to achieve the desired flowrate and pressure, cavitation may occur, resulting in a host of fuel handling problems, including fuel vapor within the fuel, hot fuel, noise and decreased pump efficiency. In order to minimize these drawbacks, the pumps must be designed to include compensating features such as vapor purge orifices, vapor purge channels, modified regenerative turbine impellers, and dual stage designs with the positive displacement stage acting at higher pressure heads. These additional features increase manufacturing costs and may complicate assembly.

A contributing factor to the abovementioned problems with conventional pumping mechanisms is the relatively short distance over which the fuel pressure is increased. For example, fuel pumped through a regenerative turbine (FIG. 13*a*) or gerotor (FIG. 13*b*) typically increases in pressure from about 0 psi to nearly 60 psi over approximately a short distance, perhaps one (1) centimeter, which is the circumferential length around the pumping element. This small distance results from size limitations on the fuel pump in addition to the physical construction required for such pumps. The present invention increases fuel pressure over a longer circumferential distance (FIG. 13*c*) thus decreasing cavitation and increasing pump efficiency.

Another drawback of regenerative turbines and gerotors is that they are typically housed in a pumping chamber formed by a cover and a bottom. The pumping chamber is then mounted within the fuel pump and fuel is drawn through an inlet in the cover, pumped around the pumping chamber, and sent through an outlet in the pump bottom leading to the interior of the pump casing. The need for this pump housing (cover and bottom) within the fuel pump increases manufacturing and assembly costs.

The present invention provides a helically shaped rotary pumping element which does not require a separate pump housing within the fuel pump, thus eliminating the need for a cover and bottom as described above. The present invention also increases fuel pressure over a longer distance than conventional pumping elements, thus reducing cavitation and problems attendant thereto, and increases pump versatility by facilitating design changes to the impeller inlet area, number of helical turns, speed, helical blade angle, and leading edge tip design.

DESCRIPTION OF THE PRIOR ART

U.S. Pat. No. 2,235,052 (Trier) discloses a screw shaped impeller 15 for a fuel pump, made of rubber or other elastic material, having a peripheral edge 16 which firmly contacts bore 6 to provide a fluid tight seal. While such a design may once have been useful, it is impractical for modern fuel pumps where high speeds would quickly wear down the impeller blade. In addition, the impeller 15 rotates in a perpendicular direction to the inlet 13 without providing the advantageous scooping action of the present invention where the impeller rotates generally in an axial direction parallel to flow through the inlet.

An existing fuel :pump by Pierburg employs a dual intermeshing screw arrangement for pumping fuel in a manner similar to a screw compressor. A working screw, which is rotated by a shaft connected to a motor, interacts with a running screw and both pump fuel from an inlet to an outlet. Such an arrangement: will result in excessive wear on the working and running screws and thus early failure. As such, it would be extremely difficult to use plastic composite materials for the screws. In addition, the design is inefficient due to the tortuous path travelled by the fuel as interacts with the two screws. A high amperage (approximately 8 amps) is also required as opposed to a smaller amperage (approximately 4 amps) required for the present invention, under similar operating conditions such as 40 psi, thus making the present invention more efficient.

Conically shaped screw impellers have been used in aircraft engines, as in U.S. Pat. No. 5,015,156 (Scholz), and for supercharging automobile engines, as in U.S. Pat. No. 1,657,055 (Woodcock).

None of the designs or disclosures just discussed, however, either teach or suggest the advantageous features of the present invention mentioned above and more fully described below.

SUMMARY OF THE INVENTION

It is an object of the present invention to provide an in-tank or in-line fuel pump having a helically shaped rotary pumping element which does not require a separate housing within the fuel pump.

A further objective is to provide a fuel pump having a helically shaped pumping element which reduces cavitation.

Another object of the present invention is to provide an electric fuel pump having a helically shaped impeller which meets net positive suction head (NPSH) flow and pressure requirements for gasoline, alcohol and diesel fuel applications.

Still another object is to provide a fuel pump having an impeller design which increases bearing and shaft life, reduces bearing and pulsation noise, and can be used with current modular pump designs with lower manufacturing costs.

It is a further object of the present invention to provide a fuel pump having a helically shaped rotary pumping element which results in primarily axial shaft forces and balanced radial loading, thus improving shaft and bearing durability by confining the shaft to true position, and increasing motor performance and life.

Yet another object of the present invention is to provide a fuel pump having a helically shaped impeller which can be used for varying applications by changing the impeller inlet area, the number of helical turns, the blade helix angle, or the motor speed.

Another object of the present invention is to provide a fuel pump having a helically shaped rotary pumping element with a leading edge designed to efficiently scoop up fuel throughout 360° of travel directly from the fuel tank to reduce low fuel, high temperature cavitation.

Still another object is to provide a helically shaped impeller which is injection molded from glass filled polymers or multi-property polymers (terpolymers), economical thermoplastic composite materials, or machined from lightweight aluminum using computerized numeric control (CNC) techniques.

It is a further object to provide a fuel pump having a helically shaped impeller troughed on a radially outer edge to contain fuel splash-back.

Another object is to provide a fuel pump having a helically shaped impeller with a narrowed width trailing edge.

The foregoing objects are accomplished by providing a fuel pump comprising a pump housing, preferably cylindrically shaped, with a motor mounted within the housing and having a shaft extending therefrom. An inlet in an end of the housing is in fluid communication with the fuel tank and with a motor chamber surrounding the motor and the shaft. A helically shaped pumping element fitted to the shaft between the inlet and the motor pumps fuel in an axial direction along the shaft from the tank, through the inlet, to the motor chamber, and to an outlet leading to the engine. The pumping element is toleranced so as not to contact the pump housing.

The helically shaped pumping element comprises a helical blade making at least two turns around an axis through the shaft. The pump housing has an end portion with the inlet therein running generally in the direction of an axis parallel to the shaft, and the helically shaped pumping element comprises a helical blade having an involute shaped leading edge which travels in an approximately perpendicular direction to an axis through the inlet and parallel to the shaft.

In the preferred embodiment, the shape of the leading edge of the helical blade is further defined such that the angle between a line perpendicular to a line tangent to the leading edge and an inner face of the end portion is approximately 5°. Additionally, the leading edge is shaped such that the distance from an inner face of the end portion to the leading edge is not more than twenty percent (20%) of the distance from the inner face of the end portion to a point on the pumping face of the first turn of the blade at which the cross-sectional area of the impeller inlet begins to remain constant for at least one blade turn.

The helical blade has a pumping side generally facing the motor with a lip forming a trough along the radially outermost portion of the blade for reducing blade tip losses. The blade has a trailing edge of reduced thickness located at an axially opposite end of the blade from the leading edge. Fuel flows through the inlet and is scooped by the leading edge into an impeller inlet in the helically shaped pumping element defined by the leading edge, the end portion, a huh, fitted to the shaft and to which the blade is attached, and a back side of a blade turn adjacent the inlet blade turn, with the back side of the blade generally facing the inlet. The opening preferably has a cross-sectional area of approximately 2 $mm^2$ to 25 $mm^2$.

The blade turns of the helically shaped impeller are preferably angled between approximately 1.5° to 4° from a line perpendicular to the shaft and are made of a thermoplastic material glass filled polymer or terpolymer, or from lightweight aluminum. The fuel pump can be mounted in-tank or in-line. To achieve the most desirable results, the motor rotates the shaft and the helically shaped pumping element at speeds between 500 rpm and 15,000 rpm for a typical automotive fuel pump impeller of approximately 38 millimeters in diameter.

FIG. **13*a*** is a cross-sectional view of a prior art pumping mechanism showing a regenerative turbine impeller within a pumping chamber.

FIG. **13*b*** is a cross-sectional view of a prior art pumping mechanism having gerotor within a pumping chamber.

FIG. **13*c*** is a cross-sectional view of a pumping mechanism according to the present invention having a helically shaped impeller.

DETAILED DESCRIPTION OF THE PREFERRED EMBODIMENTS

Figure 1:
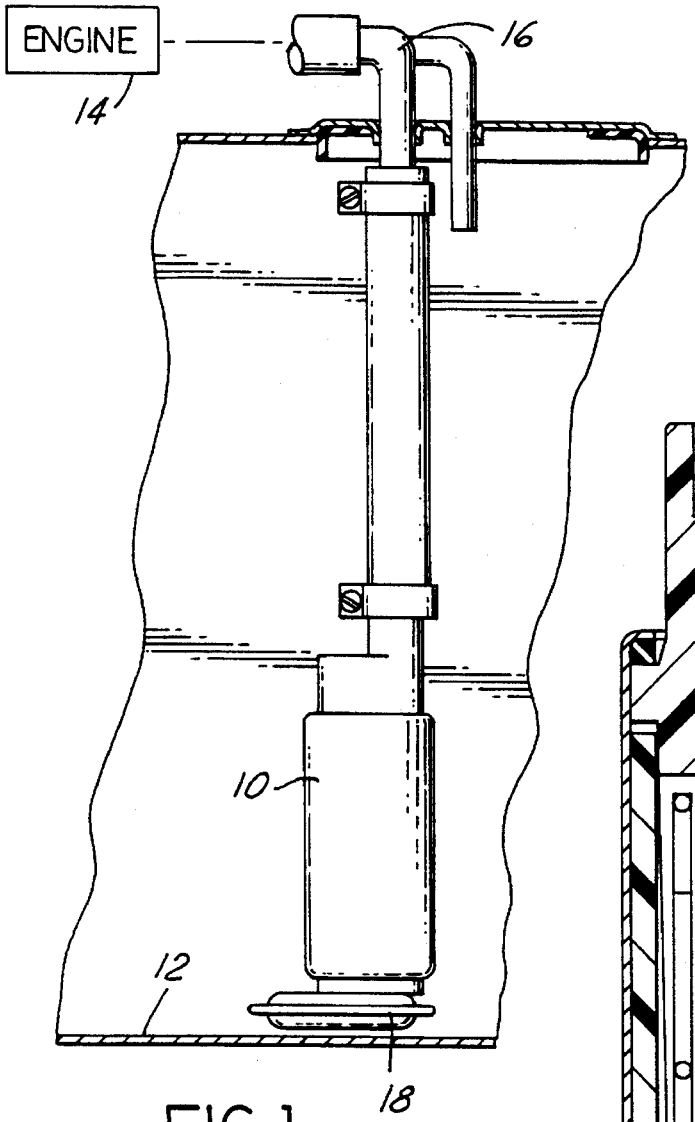
FIG. 1 shows a fuel pump according to the present invention mounted within an automotive fuel tank.

Referring now to FIG. 1, a fuel pump 10 according to the present invention is shown mounted in a known manner in an automotive fuel tank 12. A fuel line 16 connects pump 10 with engine 14. Fuel is drawn by pump 10 from tank 12 through filter 18 and is pumped through fuel line 16 to engine 14.

Figure 2:
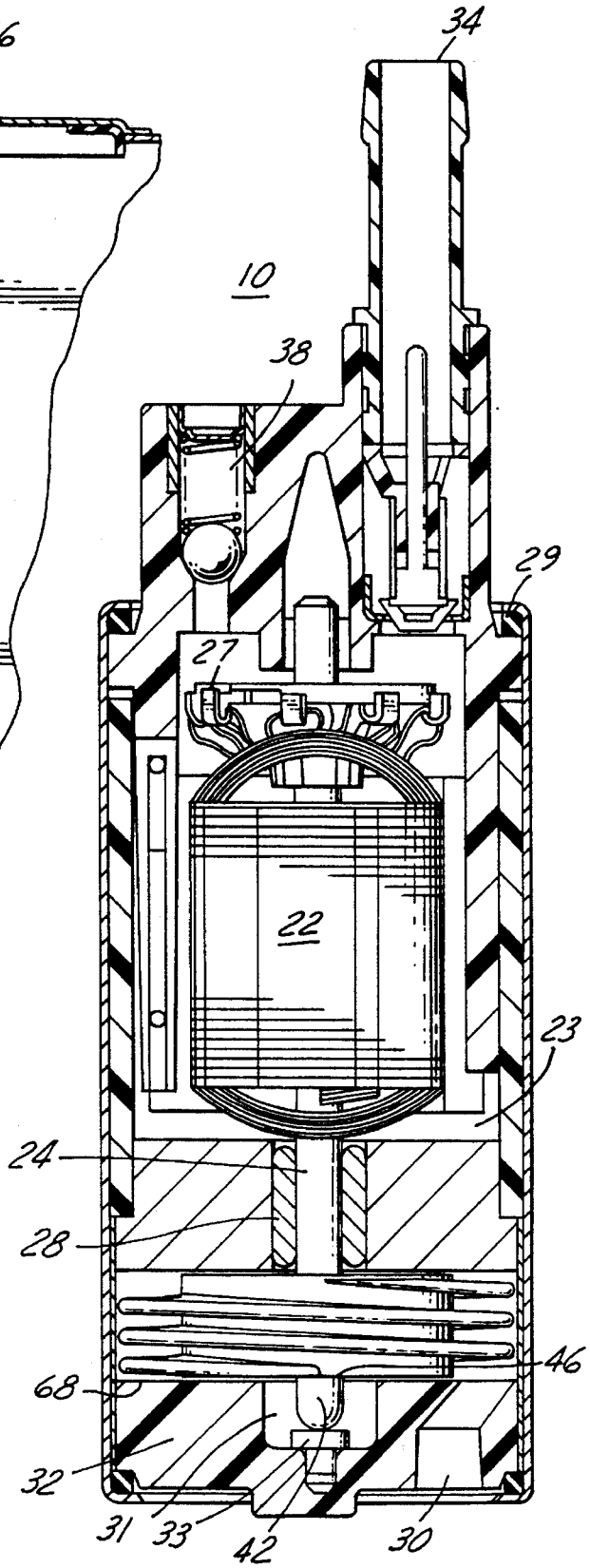
FIG. 2 is a cross-sectional view of a fuel pump according to the present invention.

A cross-sectional view of fuel pump 10 is shown in FIG. 2. Fuel pump 10 has a housing 20 for containing its inner components. A motor 22, preferably an electric motor, is mounted within motor space 36 for rotating a shaft 24 extending therefrom in the direction of end portion 32. Motor 22 is preferably driven by brushed or brushless means, but is not confined to such. A helically shaped rotary pumping element, preferably a helical impeller 26, is fitted on shaft 24 near end portion 32. Impeller 26 has a central axis which is coincident with the axis of shaft 24. End portion 32 has inlet 30 therein running generally in the direction of an axis parallel to shaft 24. Helical impeller 26 comprises a helical blade 45 having a leading edge 46 which travels in an approximately perpendicular direction to an axis through inlet 30 and parallel to shaft 24. Shaft 24 passes through shaft opening 42 in impeller 26, into recess 31 of end portion 32, and abuts thrust button 33. A thrust bearing (not shown) can be used in place of a thrust button. Shaft 24 is journaled within bearing 28.

Pressurized fuel is discharged from impeller 26 to motor space 23 and cools motor 22 while passing over it to pump outlet 34 at an end of pump 10 axially opposite inlet 30. The fuel also cleans and cools motor commutator 27, motor upper bearings 29, and motor brushes (not shown). Check valve 38 opens to lower system pressure into tank 12 should motor space 23 become overpressurized.

Figure 3:
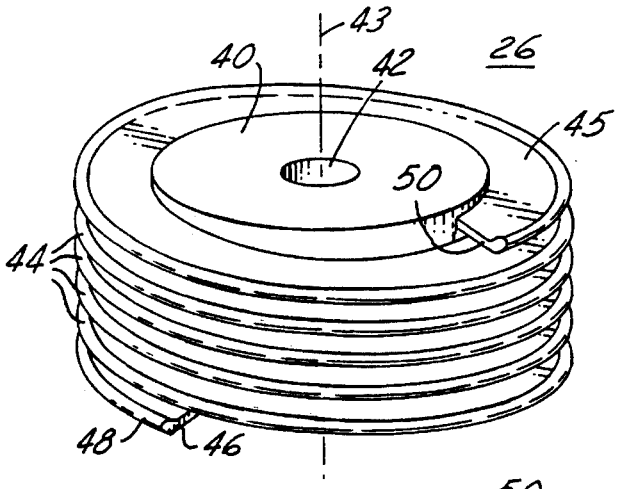
FIG. 3 is a perspective of a helically shaped pumping element according to the present invention.
Figure 4:
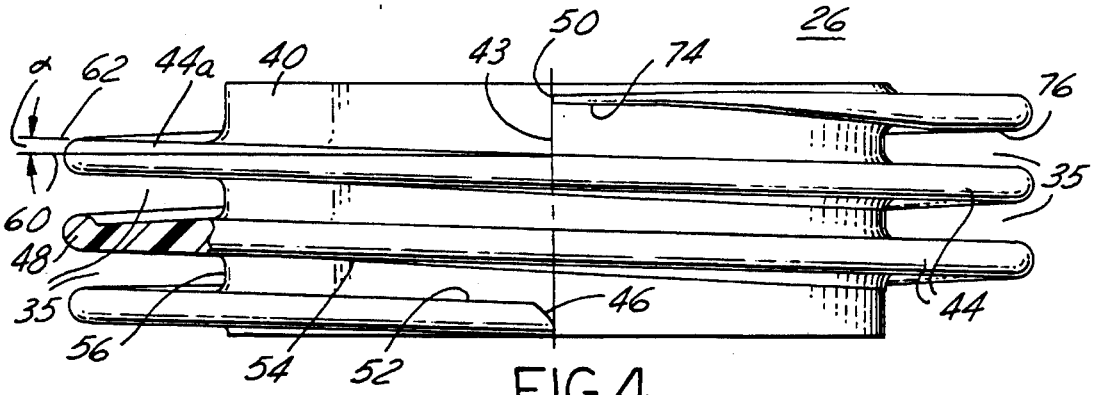
FIG. 4 is a side view of a helically shaped pumping element according to the present invention showing the leading edge, the trailing edge, and a lip on the radially outermost portion of the pumping side of the pumping element.

A perspective view of impeller 26, preferably having an outer diameter of approximately 38 millimeters, is shown in FIG. 3. Impeller 26 has a generally cylindrical hub 40 with a central axis 43 therethrough. Shaft opening 42 extends through hub 40 coaxially with central axis 43. Pumping blade 45, shown with five (5) blade turns 44, extends from hub 40. Preferably, impeller 26 has at least two (2) turns, but may have any number within the physical limitations imposed by the size of pump 10. Each turn 44 has a pumping face 52 generally facing motor 22 and a back face 54 generally facing inlet 30 (FIGS. 2 and 4). Pump 10 output pressure is directly proportional the number of blade turns 44 on impeller 26.

Blade turns 44 extend radially outward from wall 56 of hub 40 and helically wind around central axis 43, as is more clearly seen in FIG. 4. The helical turn angle, α, between lines 60 and 62 shows the helical nature of blade 44 (FIG. 4). Line 60 is perpendicular to central axis 43 and line 62 is parallel with blade turn **44*a*. Angle α preferably is approximately 2°, but satisfactory pump 10 performance is achieved between 1.5° and 4°. For low pressure applications, angle α can range up to 30°, but is limited by the physical size of pump 10 as the higher angle α becomes, the longer impeller 26 must be to accommodate angled blade turns 44**.

Still referring to FIG. 4, blade 45 has involute shaped leading edge 46 designed to efficiently funnel fuel onto pumping face 52. The axial width of blade 45 narrows on back face 54 toward trailing edge 50, as seen at the top of FIG. 4, from the width at blade section 76 to the width at blade section 74. Lip 48, on a radially outermost circumference of pumping face 52 of blade 45, forms a trough to prevent fuel splash-back between blade turns 44.

Figure 5:
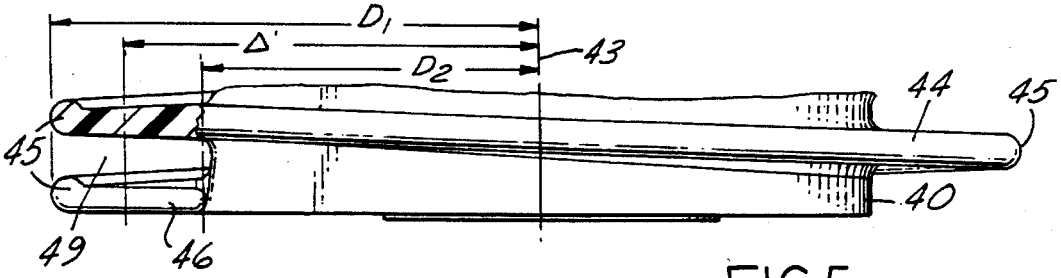
FIG. 5 is a partially cut-away view of the helically shaped pumping element of FIG. 4 rotated 90° counterclockwise about an axis through the center of the pumping element approximately perpendicular to the direction of the blades around the pumping element and showing the inlet section of the pumping element.
Figure 6:
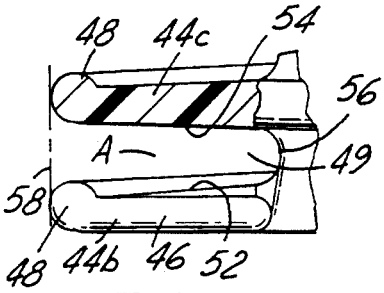
FIG. 6 is an enlargement of the inlet section of FIG. 5 showing the inlet area as defined by the first turn pumping face, the hub on which the blade is mounted, the back side of the second turn, and an inner face of the inlet end of the pump housing.

FIG. 5 is a partially cut-away side view of impeller 26, rotated 90° counterclockwise about center axis 43, showing impeller inlet 49 at leading edge 46. As better seen in FIG. 6, impeller inlet 49 is bounded by hub 56, pumping face 52 of first turn **44*b*, back face 54 of second turn 44*c*, and line 58, which is parallel to pump housing 20 (not shown). Impeller inlet 49 preferably has a cross-sectional area of approximately between 2 $mm^2$ and 25 $mm^2$, and leads to impeller pumping channel 35 which runs circumferentially around hub 40 between blades 44, as is best seen in FIG. 4. Impeller pumping channel 35 has an essentially constant cross-sectional area, A, preferably equal to the cross-sectional area of impeller inlet 49**.

The design parameters of impeller 26 influence pump 10 flowrate and output pressure. For example, it is believed that pump 10 output pressure increases as the average turn distance, D', increases (FIG. 5). Distance D' is the average of distances $D_1$, the distance from center axis 43 to the outermost circumference of blades 44 along a line perpendicular to center axis 43, and $D_2$, the distance from center axis 43 to hub 56 along a line perpendicular to center axis 43. In addition, flowrate through pump 10 is influenced by several impeller 26 variables, as shown in the following equation:

$$Q = A * \frac{(D_1 + D_2)}{2} * \pi * RPM * \frac{1}{\cos \alpha},$$

where

Q=fuel flowrate;

A=the pumping channel cross-sectional area;

$D_1$=the distance to the outermost point of the impeller from the center axis;

$D_2$=the distance to the hub of the impeller from the center axis;

RPM=revolutions per minute of the impeller;

α=the impeller blade helical angle.

Thus, pump 10 flowrate varies with the size of pumping channel cross-sectional area, A, impeller blade 45 helical angle, α, and pump 10 speed (RPms). Motor 22 typically rotates shaft 24 and impeller 26)at speeds approximately between 500 rpm and 15,000 rpm.

Figure 7:
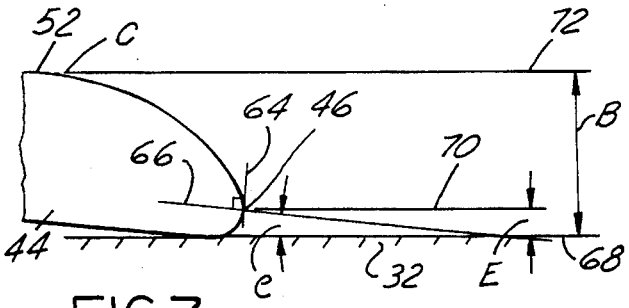
FIG. 7 is a partial cross-sectional view of the leading edge of the helically shaped impeller according to the present invention showing the involute shape of the leading edge pumping face.

A partial cross-sectional view of the involute shape of leading edge 46 of first turn 44 of blade 45 is shown in FIG. 7. Leading edge 46 is shaped such that the angle β between line 66, which is perpendicular to a line 64 that is tangent to leading edge 46, and inner face 68 of end portion 32 is between approximately 3° and 8°, and preferably is approximately 5°. Pumping face 52 of blade 44 near leading edge 46 is shaped such that the distance E from inner face 68 of end portion 32 to leading edge 46 is not more than twenty percent (20%) of the distance B from inner face 68 of end portion 32 to a point C on pumping face 52 at which the cross-sectional area of impeller inlet 49 begins to remain constant for at least one turn of blade 45.

Figure 8:
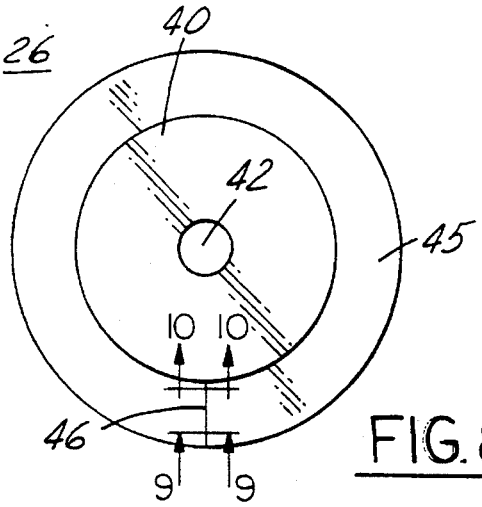
FIG. 8 is a plan view of a helically shaped pumping element according to the present invention.
Figure 9:
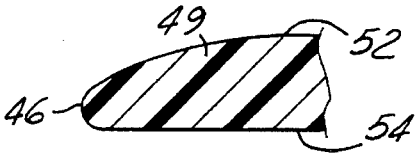
FIG. 9 is a section view along line 9—9 of FIG. 8 of the leading edge of a helically shaped pumping element according to the present invention at a radially outer lip portion of the pumping blade.
Figure 10:
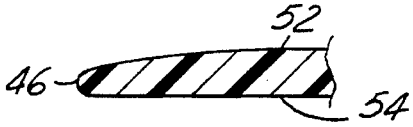
FIG. 10 is a section view along line 10—10 of FIG. 8 of the leading edge of a helically shaped pumping element according to the present invention at a radially inner portion of the pumping blade.

FIG. 8 is a plan view of impeller 26 showing blade 45 attached to hub 40., both of which are concentric with shaft opening 42. FIG. 9 is a cross-sectional view along line 9—9 of FIG. 8 at a radially outer portion of blade 45 through lip 48. FIG. 10 is a cross-sectional view along line 10—10 of FIG. 8 through leading edge 46 of impeller 26 at a radially inner portion of blade 45 showing the smaller blade 45 thickness relative lip 48 thickness as shown in FIG. 9.

Figure 11:
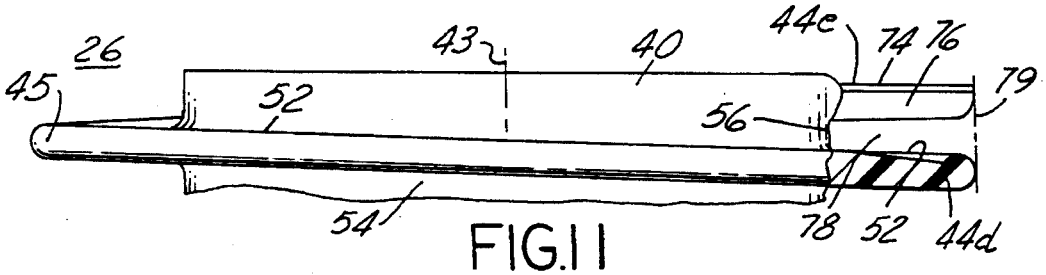
FIG. 11 is a partially cut-away view of the helically shaped pumping element of FIG. 4 rotated 90° clockwise about an axis through the center of the pumping element approximately perpendicular to the direction of the blades around the pumping element and showing the outlet section of the pumping element.

FIG. 11 shows a partially cut-away view of impeller 26 rotated 90° clockwise about center axis 43 from the position shown in FIG. 4. Impeller outlet 78 is bounded by hub 56, pumping face 52 of second-to-last blade turn **44*d*, back face 54 of last turn 44*e*, and line 79, which is parallel to pump housing 20 (not shown). The cross-sectional area of impeller outlet 78, which preferably is larger than the cross-sectional area of impeller pumping channel 35, is preferably approximately between 3 $mm^2$ and 36 $mm^2$. This increase in cross-sectional area is accomplished by reducing the axial width of blade 45 on back face 54 toward trailing edge 50, as seen at the top of FIG. 4, from the width at blade section 76 to the width at blade section 74**.

Figure 12:
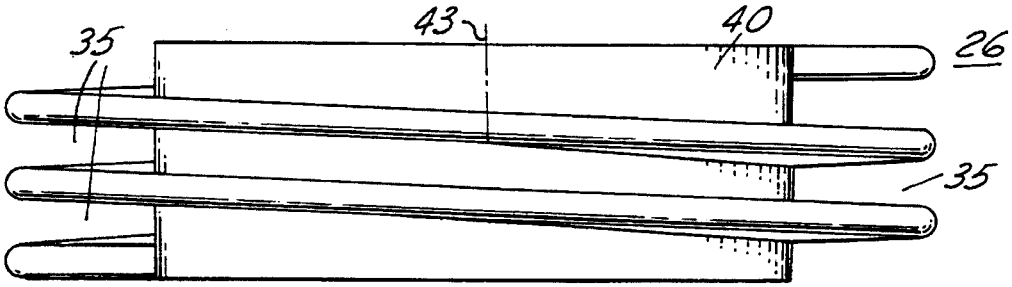
FIG. 12 is a back view of the helically shaped pumping element of FIG. 4 rotated 180° about an axis through the center of the pumping element approximately perpendicular to the direction of the blades around the pumping element.
Figure 13A:
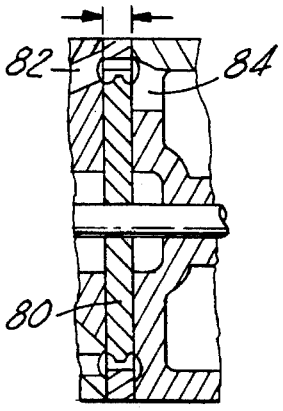
Figure 13B:
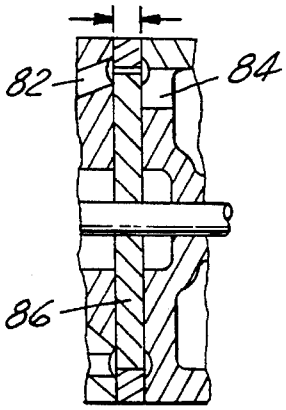
Figure 13C:
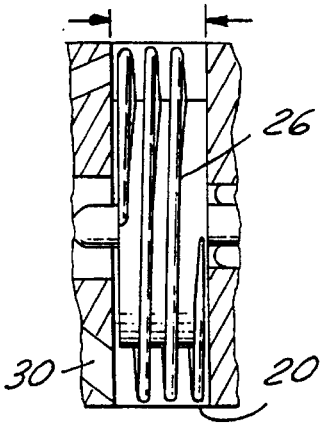

FIG. 12 is a back view of impeller 26 rotated 180° about center axis 43 from the view of FIG. 4 showing impeller pumping channel 35 between blades 44.

In operation, as motor 22 rotates impeller 26 on shaft 24, fuel is drawn from tank 12 through inlet 30, is scooped up by leading edge 46 into impeller inlet 49, and is propelled axially toward motor 22 and radially toward pump housing 20 through impeller pumping channel 35. Rotation of impeller 26 imparts both an axial force component and a radial force component to the fuel due to the helical shape of blade 45 around hub 40. When the fuel reaches impeller outlet 78, fuel pressure increases at impeller outlet 78 due to the increased cross-sectional area, as discussed above, and flows into motor space 23.

Impeller 26 is preferably injection molded using glass filled polymers or multi-property polymers (ter-polymers) or other plastic, thermoplastic, or nonplastic materials known to those skilled in the art and suggested by this disclosure. Alternatively, impeller 26 can be machined out of light-weight aluminum using computerized numeric control (CNC) methods.

Although the preferred embodiment of the present invention has been disclosed, various changes and modifications may be made without departing from the scope of the invention as set forth in the appended claims.

We claim:

1. A fuel pump for supplying fuel from a fuel tank to an automotive engine, comprising:

a pump housing;

a motor mounted within a motor chamber within said housing and having a shaft extending therefrom;

an inlet in an end of said housing in fluid communication with said tank; and a helically shaped pumping element fitted to said shaft between said inlet and said motor for pumping fuel in a generally axial direction from said tank, through said inlet, to said motor chamber, and to an outlet leading to said engine, with said pumping element being toleranced so as not to contact said pump housing;

said helically shaped pumping element comprising a helical blade making at least two turns around a longitudinal axis through said shaft, and wherein said at least two turns have a pumping face generally facing said motor and a back face generally facing said inlet;

so that fuel flows from said tank, through said inlet, and is scooped by said leading edge into an impeller inlet in said helically shaped pumping element defined by said leading edge, said housing, a hub fitted to said shaft and to which said blade is attached, and a back side of a blade turn adjacent said inlet blade turn, said back side of said blade generally facing said inlet.

2. A fuel pump according to claim 1 wherein said leading edge is shaped such that the distance from an inner face of said end portion to said leading edge is not more than twenty percent (20%) of the distance from said inner face of said end portion to a point on said pumping face of said first turn of said blade at which the cross-sectional areas of said impeller inlet begins to remain constant for at least one blade turn.

3. A fuel pump according to claim 2 wherein said impeller inlet has a cross-sectional area of approximately 2 $mm^2$ to 25 $mm^2$.

4. A fuel pump according to claim 1 wherein said blade has a trailing edge of reduced thickness located at an axially opposite end of said blade from said leading edge.

5. A fuel pump according to claim 1 wherein said at least two turns of said blade are angled between approximately 1.5° to 4° from a line perpendicular to said shaft.

6. A fuel pump according to claim 1 wherein said fuel pump is mounted within said fuel tank.

7. A fuel pump according to claim 1 wherein said helically shaped pumping element is made of a thermoplastic material.

8. A fuel pump according to claim 1 wherein said motor rotates said shaft and said helically shaped pumping element at speeds between 500 rpm and 15,000 rpm.

9. A fuel pump mounted within a fuel tank for supplying fuel to an automotive engine, the fuel pump comprising:

a cylindrically shaped pump housing;

a motor mounted within a motor chamber within said housing and having a shaft extending therefrom;

an inlet in an end of said housing, running generally in the direction of an axis parallel to said shaft, in fluid communication with said tank;

a helically shaped pumping element toleranced so as not to contact said pump housing and fitted to said shaft between said inlet and said motor for pumping fuel in a generally axial direction said tank, through said inlet, to said motor chamber, and to an outlet leading to said engine, said pumping element also comprising a helical blade making at least two turns around an axis through said shaft and having a leading edge with an involute shaped cross-section which travels in an approximately perpendicular direction to an axis through said inlet and parallel to said shaft; and wherein said leading edge is shaped such that the angle between a line perpendicular to a line tangent to said leading edge and an inner face of said end portion is approximately 5°, with said leading edge being shaped such that the distance from an inner face of said end portion to said leading edge is not more than twenty percent (20%) of the distance from said inner face of said end portion to a point on said pumping face of said first turn of said blade at which the cross-sectional areas of said impeller inlet begins to remain constant for at least one blade turn.

10. A fuel pump according to claim 9 wherein said leading edge is shaped such that the angle between a line perpendicular to a line tangent to said leading edge and an inner face of said end portion is approximately 5°, with said leading edge being shaped such that the distance from an inner face of said end portion to said leading edge is not more than twenty percent (20%) of the distance from said inner face of said end portion to a point on said pumping face of said first turn of said blade at which the cross-sectional areas of said impeller inlet begins to remain constant for at least one blade turn.

11. A fuel pump according to claim 9 wherein said blade has a pumping side generally facing said motor, said pumping side having a lip along the radially outermost portion of said blade for reducing blade tip losses, and wherein said blade has a trailing edge of reduced thickness located at an axially opposite end of said blade from said leading edge.

12. A fuel pump according to claim 11 wherein fuel flows from said tank, through said inlet, and is scooped by said leading edge into an opening in said helically shaped pumping element defined by said leading edge, said pump housing, a hub fitted to said shaft and to which said blade is attached, and a back side of a blade turn adjacent said inlet blade turn, said back side of said blade generally facing said inlet, said opening having a cross-sectional area of approximately between 2 $mm^2$ to 25 $mm^2$.

13. A fuel pump mounted within a fuel tank for supplying fuel from said fuel tank to an automotive engine, said fuel pump comprising:

a cylindrically shaped pump housing;

a motor mounted within a motor chamber within said housing and having a shaft extending therefrom;

an inlet in an end of said housing in fluid communication with said tank; and a helically shaped blade, molded of thermoplastic material, toleranced so as not to contact said pump housing and fitted to said shaft between said inlet and said motor for pumping fuel generally in a direction of an axis through said shaft, said blade having a pumping side, generally facing said motor, with a lip along the radially outermost portion of said blade for reducing blade tip losses, and wherein said blade has a trailing edge of reduced thickness located at an axially opposite end of said blade from said leading edge, said helical blade making at least two turns around an axis through said shaft and having a leading edge with an involute shaped cross-section which travels in an approximately perpendicular direction to an axis through said inlet such that fuel flows from said tank, through said inlet, and is scooped by said leading edge into an opening in said helically shaped pumping element defined by said leading edge, said pump housing, a hub fitted to said shaft and to which said blade is attached, and a back side of a blade turn adjacent said inlet blade turn, said back side of said blade generally facing said inlet, said leading edge shaped such that the angle between a line perpendicular to a line tangent to said leading edge and an inner face of said end portion is approximately 5°, with said leading edge also being shaped such that the distance from an inner face of said end portion to said leading edge is not more than twenty percent (20%) of the distance from said inner face of said end portion to a point on said pumping face of said first turn of said blade at which the cross-sectional areas of said impeller inlet begins to remain constant for at least one blade turn.

14. A fuel pump according to claim 13 wherein said opening has a cross-sectional area of approximately 2 $mm^2$ to 25 $mm^2$.

15. A fuel pump according to claim 13 wherein said motor turns said shaft and said helically shaped pumping element at speeds between 500 rpm and 15,000 rpm.

16. A fuel pump for supplying fuel from a fuel tank to an automotive engine, comprising:

a pump housing;

a motor mounted within a motor chamber within said housing and having a shaft extending therefrom;

an inlet in an end of said housing in fluid communication with said tank; and a helically shaped pumping element fitted to said shaft between said inlet and said motor for pumping fuel in a generally axial direction from said tank, through said inlet, to said motor chamber, and to an outlet leading to said engine, with said pumping element being toleranced so as not to contact said pump housing;

wherein said pump housing has an end portion with said inlet therein running generally in the direction of an axis parallel to said shaft, and wherein said helically shaped pumping element comprises a helical blade having a leading edge which travels in an approximately perpendicular direction to an axis through said inlet and parallel to said shaft; said leading edge shaped such that the angle between a line perpendicular to a line tangent to said leading edge and an inner face of said end portion is approximately 5°.

17. A fuel pump according to claim 16 wherein said blade has a pumping side generally facing said motor, said pumping side having a lip along the radially outermost portion of said blade for reducing blade tip losses.

* * * * *